US009341984B2

(12) United States Patent
Asai

(10) Patent No.: US 9,341,984 B2
(45) Date of Patent: May 17, 2016

(54) DEVELOPING APPARATUS WITH BACKFLOW PREVENTION PORTION AND IMAGE FORMING APPARATUS WITH BACKFLOW PREVENTION PORTION

(71) Applicant: Funai Electric Co., Ltd., Daito-shi, Osaka (JP)

(72) Inventor: Toshinori Asai, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 0 days.

(21) Appl. No.: 14/186,556

(22) Filed: Feb. 21, 2014

(65) Prior Publication Data

US 2014/0270854 A1 Sep. 18, 2014

(30) Foreign Application Priority Data

Mar. 12, 2013 (JP) ..... 2013-049584

(51) Int. Cl.
*G03G 15/08* (2006.01)

(52) U.S. Cl.
CPC ..... *G03G 15/0886* (2013.01); *G03G 15/0839* (2013.01); *G03G 15/0865* (2013.01); *G03G 15/0875* (2013.01); *G03G 15/0879* (2013.01); *G03G 15/0874* (2013.01)

(58) Field of Classification Search
CPC ..... G03G 15/0839; G03G 15/0865; G03G 15/0877; G03G 15/0879; G03G 15/0874; G03G 15/0875; G03G 15/0886
USPC ..... 399/257, 258, 260, 264
See application file for complete search history.

(56) References Cited

U.S. PATENT DOCUMENTS

| | | | | |
|---|---|---|---|---|
| 4,565,435 | A * | 1/1986 | Hart | 399/257 |
| 4,993,829 | A * | 2/1991 | Naganuma et al. | 399/260 |
| 8,346,137 | B2 * | 1/2013 | Gyoutoku et al. | 399/273 |
| 2003/0175051 | A1 * | 9/2003 | Sato et al. | 399/260 |
| 2006/0204281 | A1 * | 9/2006 | Wada et al. | 399/227 |
| 2008/0226311 | A1 * | 9/2008 | Senoh et al. | 399/27 |
| 2011/0318062 | A1 | 12/2011 | Hayashi et al. | |

FOREIGN PATENT DOCUMENTS

| | | | |
|---|---|---|---|
| JP | 6-208296 | A | 7/1994 |
| JP | 8-69180 | A | 3/1996 |
| JP | 08069166 | A * | 3/1996 |
| JP | 2000-147889 | A | 5/2000 |
| JP | 2000-310905 | A | 11/2000 |
| JP | 2002-6634 | A | 1/2002 |
| JP | 2002182462 | A * | 6/2002 |
| JP | 2005308908 | A * | 11/2005 |
| JP | 2006293199 | A * | 10/2006 |
| JP | 2008-107442 | A | 5/2008 |
| JP | 2008-216898 | A | 9/2008 |
| JP | 2009-69511 | A | 4/2009 |
| JP | 4547179 | B2 | 9/2010 |

OTHER PUBLICATIONS

European Search Report dated Sep. 1, 2014 (six (6) pages).

* cited by examiner

*Primary Examiner* — Robert Beatty
(74) *Attorney, Agent, or Firm* — Crowell & Moring LLP

(57) ABSTRACT

This developing apparatus includes a toner supply passage for supplying new toner fed from a toner cartridge to a toner carrying region where a toner carrier is arranged, and the toner supply passage is provided with a backflow prevention portion for preventing old toner from backflowing toward the toner cartridge.

19 Claims, 8 Drawing Sheets

DEVELOPING APPARATUS WITH BACKFLOW PREVENTION PORTION AND IMAGE FORMING APPARATUS WITH BACKFLOW PREVENTION PORTION

BACKGROUND OF THE INVENTION

1. Field of the Invention

The present invention relates to a developing apparatus and an image forming apparatus, and more particularly, it relates to a developing apparatus and an image forming apparatus each including a toner carrier for supplying toner to an electrostatic latent image formed on an image carrier.

2. Description of the Background Art

An image forming apparatus including a developing apparatus including a toner carrier for supplying toner to an electrostatic latent image formed on an image carrier is known in general, as disclosed in Japanese Patent Laying-Open No. 2008-107442, for example.

The aforementioned Japanese Patent Laying-Open No. 2008-107442 discloses an image forming apparatus including a developing apparatus including a photosensitive belt forming an electrostatic latent image, a developing unit including a developing roller for supplying toner to the electrostatic latent image formed on the photosensitive belt, a toner cartridge storing the toner and having a passage supplying the toner to the developing unit, a control valve arranged in the developing unit for opening/closing the passage of the toner cartridge and a transport paddle controlling opening/closing of the control valve. In the developing apparatus of the image forming apparatus, the transport paddle is configured to open the control valve not only to supply the toner from the toner cartridge toward the developing unit but also to supply (eject) the toner from the developing unit toward the toner cartridge.

In the developing apparatus of the image forming apparatus described in the aforementioned Japanese Patent Laying-Open No. 2008-107442, however, the transport paddle opens the control valve also to supply (eject) the toner from the developing unit toward the toner cartridge, and hence old toner remaining in the developing unit may be returned toward the toner cartridge, to come into contact with new toner. In general, toner is positively or negatively charged in a normal state, while the quantity of charge of the toner is reduced following the lapse of time or due to adhesion to the developing roller, leading to deterioration of the toner. When such deteriorated old toner comes into contact with new toner, the new toner so removes charge from the old toner that the old toner is reversely charged (negatively charged when having been positively charged in the normal state, and vice versa). When the reversely charged old toner is supplied to the photosensitive belt through the developing roller, the old toner adheres to a region of the photosensitive belt where no electrostatic latent image is formed. Consequently, the old toner adheres to a region of a printing paper irrelevant to the electrostatic latent image, to disadvantageously cause smudging (scumming) on the printing paper.

SUMMARY OF THE INVENTION

The present invention has been proposed in order to solve the aforementioned problem, and an object of the present invention is to provide a developing apparatus capable of preventing a printing paper from smudging resulting from adhesion of toner to a region of the printing paper irrelevant to an electrostatic latent image and an image forming apparatus including the developing apparatus.

A developing apparatus according to a first aspect of the present invention includes an image carrier forming an electrostatic latent image, a toner carrier for supplying toner to the electrostatic latent image formed on the image carrier and a toner supply passage for supplying new toner fed from a toner cartridge to a toner carrying region where the toner carrier is arranged, while the toner supply passage is provided with a backflow prevention portion for preventing old toner from backflowing toward the toner cartridge.

In the developing apparatus according to the first aspect of the present invention, as hereinabove described, the toner supply passage is provided with the backflow prevention portion for preventing the old toner from backflowing toward the toner cartridge so that the backflow prevention portion prevents the old toner remaining in the toner supply passage or the toner carrying region from backflowing toward the toner cartridge and coming into contact with the new toner fed from the toner cartridge, whereby the same can prevent the old toner from adhering to a region of the image carrier where no electrostatic latent image is formed. Consequently, the developing apparatus can prevent the toner from adhering to a region of a printing paper irrelevant to the electrostatic latent image, whereby the printing paper can be prevented from smudging (scumming).

In the aforementioned developing apparatus according to the first aspect, the toner supply passage preferably includes a first chamber connected to the toner cartridge and a second chamber connected to the first chamber and the toner carrying region, and the backflow prevention portion is preferably configured to prevent the old toner from backflowing from the second chamber toward the first chamber. According to this structure, the backflow prevention portion can prevent the old toner remaining in the second chamber from backflowing toward the first chamber and coming into contact with the new toner present in the first chamber.

In the aforementioned developing apparatus according to the first aspect, the backflow prevention portion preferably includes a barrier portion having a mesh member for preventing the old toner from backflowing toward the toner cartridge. According to this structure, the barrier portion can easily prevent the old toner remaining in the toner supply passage or the toner carrying region from backflowing toward the toner cartridge.

In the aforementioned developing apparatus according to the first aspect, the backflow prevention portion preferably has such a structure that the height position descends toward the toner carrying region. According to this structure, the toner carrier can easily supply the toner toward the toner carrying region due to the own weight thereof, while the backflow prevention portion can easily prevent the old toner from backflowing from the toner carrying region toward the toner cartridge.

In this case, the toner supply passage preferably includes a first chamber connected to the toner cartridge and a second chamber connected to the first chamber and the toner carrying region, and the bottom surface of the second chamber is preferably positioned below the bottom surface of the first chamber, thereby constituting the backflow prevention portion. According to this structure, the backflow prevention portion can more reliably prevent the old toner from backflowing from the second chamber toward the first chamber due to the own weight thereof, whereby the same can more reliably prevent the old toner remaining in the second chamber from backflowing toward the first chamber and coming into contact with the new toner present in the first chamber.

In the aforementioned structure in which the bottom surface of the second chamber is positioned below the bottom surface of the first chamber, the toner supply passage preferably has a stepwise structure so stepwisely connected that the height position descends toward the toner carrying region due to the bottom surface of the first chamber and the bottom surface of the second chamber. According to this structure, the backflow prevention portion can effectively prevent the old toner from backflowing from the second chamber toward the first chamber due to the own weight thereof, whereby the same can effectively prevent the old toner remaining in the second chamber from backflowing toward the first chamber and coming into contact with the new toner present in the first chamber.

In the aforementioned developing apparatus according to the first aspect, the toner supply passage preferably includes a first chamber connected to the toner cartridge and a second chamber connected to the first chamber and the toner carrying region, at least either the first chamber or the second chamber is preferably configured to be so deformable that the volume is reduced, and the backflow prevention portion preferably includes a pressing portion for pressing at least either deformable one of the first chamber and the second chamber toward the toner carrying region. According to this structure, the pressing portion can apply pressing force to the toner for moving the same toward the toner carrying region, whereby the toner carrier can easily supply the toner toward the toner carrying region, while the backflow prevention portion can prevent the old toner from backflowing toward the toner cartridge.

In this case, the pressing portion preferably includes a receiving member receiving the toner cartridge thereon, and the developing apparatus preferably further includes a driving mechanism for moving the receiving member to press at least either deformable one of the first chamber and the second chamber toward the toner carrying region. According to this structure, the driving mechanism can control pressing force of the receiving member, whereby the toner carrier can reliably supply the toner toward the toner carrying region.

In the aforementioned structure including the pressing portion, at least either deformable one of the first chamber and the second chamber has a bellows structure so deformable that the volume is reduced toward the toner carrying region. According to this structure, the pressing portion can easily apply the pressing force to the toner for moving the same toward the toner carrying region, whereby the toner carrier can easily supply the toner toward the toner carrying region.

In the aforementioned structure in which at least either the first chamber or the second chamber is deformable, both of the first chamber and the second chamber are preferably configured to be so deformable that the volumes are reduced, and the first chamber is preferably configured to deform with force smaller than that for the second chamber. According to this structure, the second chamber closer to the toner carrying region can be deformed after deforming the first chamber closer to the toner cartridge, whereby the developing apparatus can be prevented from formation of force backflowing the toner from the second chamber toward the first chamber due to preceding deformation of the second chamber.

In the aforementioned structure in which the backflow prevention portion includes the barrier portion having the mesh member, the mesh member of the barrier portion preferably has a mesh width larger than the average particle diameter of the toner. According to this structure, the mesh member of the barrier portion can reliably prevent the old toner increased in particle diameter due to agglomeration from backflowing toward the toner cartridge while reliably supplying toner of not more than the average particle diameter toward the toner carrying region.

In the aforementioned structure in which the backflow prevention portion includes the barrier portion having the mesh member, the mesh member of the barrier portion is preferably arranged in a state so inclined that the upper end is closer to the toner carrying region. According to this structure, it follows that toner present in a portion closer to the toner cartridge is positioned above the inclinedly arranged mesh member while that present in a portion closer to the toner carrying region is positioned under the inclinedly arranged mesh member, whereby the toner carrier can easily supply the toner toward the toner carrying region due to the own weight thereof, and the backflow prevention portion can easily prevent the toner from backflowing from the toner carrying region toward the toner cartridge.

In the aforementioned developing apparatus according to the first aspect, the backflow prevention portion of the toner supply passage preferably has a structure gradually narrowing from a side closer to the toner cartridge toward the toner carrying region. According to this structure, the backflow prevention portion can limit the quantity of toner backflowing from the toner carrying region on the narrowest position thereof, whereby the same can easily prevent the old toner from backflowing from the toner carrying region toward the toner cartridge.

In the aforementioned developing apparatus according to the first aspect, the backflow prevention portion preferably includes a lid member blocking the toner supply passage in a state urged toward the toner cartridge, and the lid member is preferably configured to pass the toner toward the toner carrying region and to prevent the toner from backflowing toward the toner cartridge. According to this structure, the toner carrier can easily supply the toner toward the toner carrying region, while the backflow prevention portion can easily prevent the old toner from backflowing toward the toner cartridge.

The aforementioned developing apparatus according to the first aspect preferably further includes an old toner recovery portion for recovering the old toner adhering to the toner carrier. According to this structure, the developing apparatus can prevent remarkably deteriorated old toner almost losing charge due to charge removal in the toner carrier from returning to the toner carrying region, whereby the same can reliably prevent the remarkably deteriorated old toner from coming into contact with the new toner.

In this case, the developing apparatus is preferably configured to perform a toner recovering operation for recovering the old toner into the old toner recovery portion when the toner cartridge is to be replaced with a new toner cartridge. According to this structure, the developing apparatus can recover the old toner before a new toner cartridge supplies new toner, whereby the same can reliably prevent the old toner from coming into contact with the new toner. Further, the old toner recovery portion so recovers the old toner adhering to the toner carrier that the image carrier may not stick the old toner thereto for recovering the same, whereby the number of times of sticking the toner to the image carrier can be reduced. Thus, the image carrier can be prevented from deterioration in an early stage.

In the aforementioned structure including the old toner recovery portion, the old toner recovery portion preferably includes an old toner recovery member, the old toner recovery member preferably includes a storage portion formed inside the old toner recovery member for storing the old toner and a shutter portion provided on the upper surface of the old toner recovery member, and the shutter portion is preferably configured to expose the storage portion from the upper surface of the old toner recovery member by opening when the old toner recovery member is mounted on the developing apparatus, and configured not to expose the storage portion from the upper surface of the old toner recovery member by closing when the old toner recovery member is detached from the developing apparatus. According to this structure, the shutter portion can prevent the old toner stored in the storage portion from flying up into the air when the old toner recovery member is extracted from the developing apparatus.

In this case, the old toner recovery portion preferably includes a blade portion arranged in the developing apparatus for recovering the old toner, and the shutter portion preferably has a protrusion projecting upward, is so configured that the protrusion and the blade portion come into contact with each other so that the shutter portion opens when the old toner recovery member is mounted on the developing apparatus, and configured to close due to urging force applied in a direction where the shutter portion closes when the old toner recovery member is detached from the developing apparatus. According to this structure, the shutter portion can be configured to easily open when the old toner recovery member is mounted on the developing apparatus due to the blade portion and to easily close when the old toner recovery member is detached from the developing apparatus.

In the aforementioned structure in which the backflow prevention portion includes the barrier portion having the mesh member, the backflow prevention portion preferably includes a plurality of barrier portions provided with mesh members having height positions different from each other, and the plurality of barrier portions are preferably so configured that the height positions of the mesh members descend toward the toner carrying region. According to this structure, the barrier portions can prevent the old toner remaining in the toner supply passage or the toner carrying region from backflowing toward the toner cartridge, while the toner carrier can supply the new toner toward the barrier portion(s) provided with the mesh member(s) having lower height position(s) among the plurality of barrier portions, due to the own weight of the toner.

An image forming apparatus according to a second aspect of the present invention is an image forming apparatus including a toner cartridge storing new toner and a developing apparatus, while the developing apparatus includes an image carrier forming an electrostatic latent image, a toner carrier for supplying toner to the electrostatic latent image formed on the image carrier and a toner supply passage for supplying the new toner fed from the toner cartridge to a toner carrying region where the toner carrier is arranged, and the toner supply passage of the developing apparatus is provided with a backflow prevention portion for preventing old toner from backflowing toward the toner cartridge.

In the image forming apparatus according to the second aspect of the present invention, as hereinabove described, the toner supply passage of the developing apparatus is provided with the backflow prevention portion for preventing the old toner from backflowing toward the toner cartridge so that the backflow prevention portion prevents the old toner remaining in the toner supply passage or the toner carrying region from backflowing toward the toner cartridge and coming into contact with the new toner fed from the toner cartridge, whereby the same can prevent the old toner from adhering to a region of the image carrier where no electrostatic latent image is formed. Consequently, the image forming apparatus can prevent the toner from adhering to a region of a printing paper irrelevant to the electrostatic latent image, whereby the printing paper can be prevented from smudging (scumming).

According to the present invention, as hereinabove described, a printing paper can be prevented from smudging due to toner adhering to a region of the printing paper irrelevant to an electrostatic latent image.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

(First Embodiment)

The structure of an image forming apparatus 100 according to a first embodiment of the present invention is described with reference to FIGS. 1 to 5.

Figure 1:
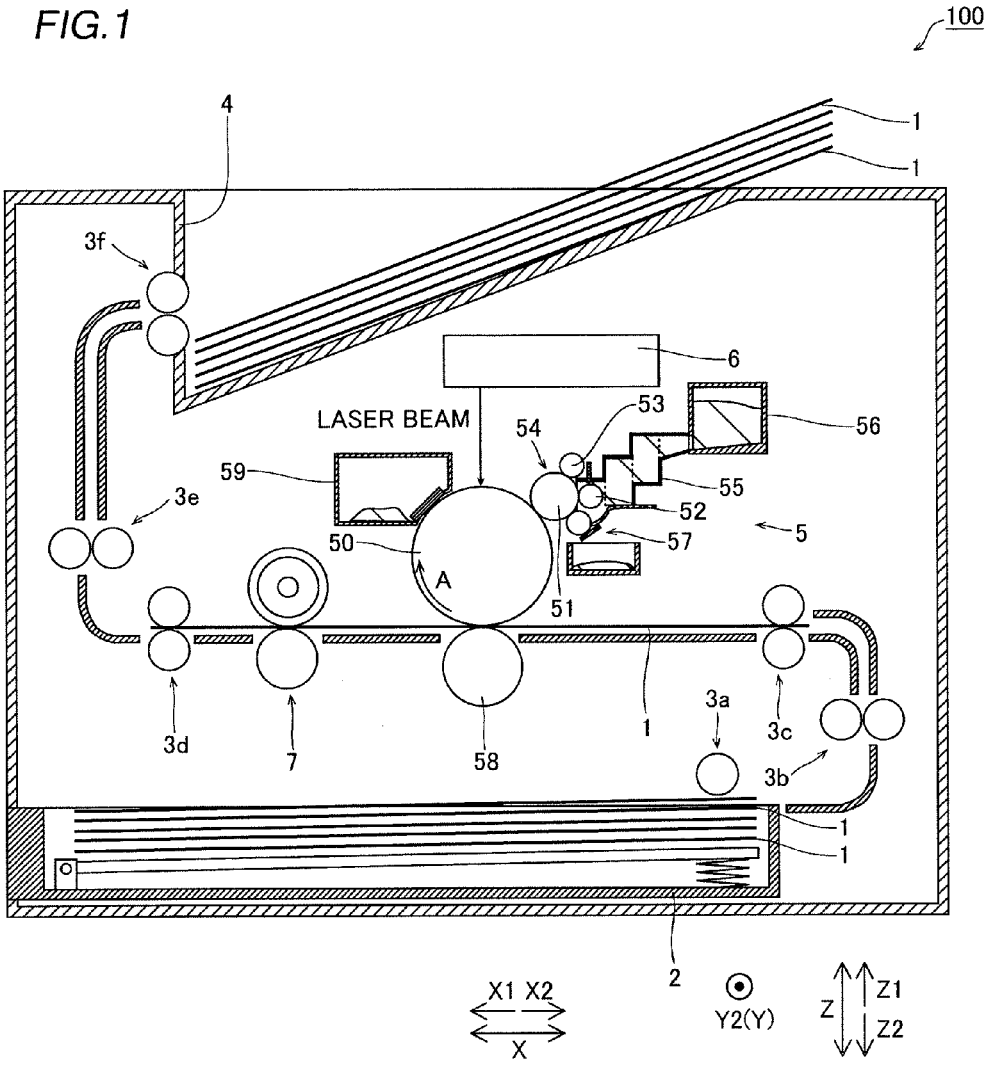
FIG. 1 is a schematic diagram showing the overall structure of an image forming apparatus according to a first embodiment of the present invention.

The image forming apparatus 100 is the so-called laser printer printing images on printing papers 1 by sticking toner to the printing papers 1 through a laser beam, as shown in FIG. 1. The image forming apparatus 100 includes a paper feed tray 2 loaded with the printing papers 1, take-up rollers 3*a* for transporting each printing paper 1 from the paper feed tray 2, paper feed rollers 3*b* and 3*c* for transporting the printing paper 1 to a printing position, and transport rollers 3*d* and 3*e* for transporting each printed printing paper 1. The image forming apparatus 100 also includes a paper ejection tray 4 for receiving the printed printing paper 1 ejected thereto and a paper ejection roller 3*f* for ejecting the printed printing paper 1 to the paper ejection tray 4. The image forming apparatus 100 further includes a developing apparatus 5 for printing the images on each printing paper 1, a laser emission portion 6 for applying the laser beam to a photosensitive drum 50 of the developing apparatus 5 and a heating roller 7 for fixing the toner adhering to the printing paper 1.

The developing apparatus 5 includes the photosensitive drum 50 for printing the images on the printing paper 1 by sticking the toner thereto, a developing roller 51 for supplying the toner to the developing roller 51 and a restriction roller 53, as shown in FIG. 1. All of the developing roller 51, the supply roller 52 and the restriction roller 53 are arranged in a toner carrying region 54. The photosensitive drum 50 and the developing roller 51 are examples of the "image carrier" and the "toner carrier" in the present invention respectively.

The developing apparatus 5 also includes a toner supply passage 55 supplying the toner to the toner carrying region 54, a toner cartridge 56 storing new toner and an old toner recovery portion 57 for recovering old toner adhering to the developing roller 51 or that present in the periphery of the developing roller 51. The developing apparatus 5 further includes a transfer roller 58 arranged on a position opposed to the photosensitive drum 50 for transferring toner adhering to the photosensitive drum 50 to the printing paper 1 and a cleaning portion 59 for recovering toner remaining on the photosensitive drum 50.

The toner consists of fine particles prepared by bonding color particles of carbon or the like to negatively charged plastic particles. The negative charge (quantity of charge) of the toner is reduced following the lapse of time or due to adhesion of the toner to the developing roller 51, leading to deterioration of the toner. When such deteriorated old toner comes into contact with new toner, the new toner so removes charge from the old toner that the old toner starts to be positively charged. At this time, the old toner easily agglomerates due to potential difference between the old toner and the new toner. The agglomerating old toner has particle diameters larger than the average particle diameter of normal toner.

The photosensitive drum 50 is so configured that the surface thereof is negatively charged. At the time of printing, the laser emission portion 6 first applies the laser beam to a prescribed surface position of the photosensitive drum 50 along a rotational direction A thereof, and removes negative charge from the surface of the position subjected to the application of the laser beam. Thus, an electrostatic latent image is formed on the region of the surface of the photosensitive drum 50 from which the negative charge is removed. Thereafter the toner supplied by the developing roller 51 adheres to the electrostatic latent image formed on the photosensitive drum 50. Then, the positively charged transfer roller 58 moves the negatively charged toner from the photosensitive drum 50 toward the transfer roller 58, thereby adsorbing (transferring) the toner to the printing paper 1 arranged between the transfer roller 58 and the photosensitive drum 50. Consequently, an image is printed on the printing paper 1 on the basis of the electrostatic latent image formed on the photosensitive drum 50.

After the negative charge is removed from the surface of the photosensitive drum 50, the cleaning portion 59 recovers toner remaining on the surface. Finally, an electrode (not shown) negatively charges the surface of the photosensitive drum 50 again, so that the image forming apparatus 100 performs a printing operation again.

Figure 2:
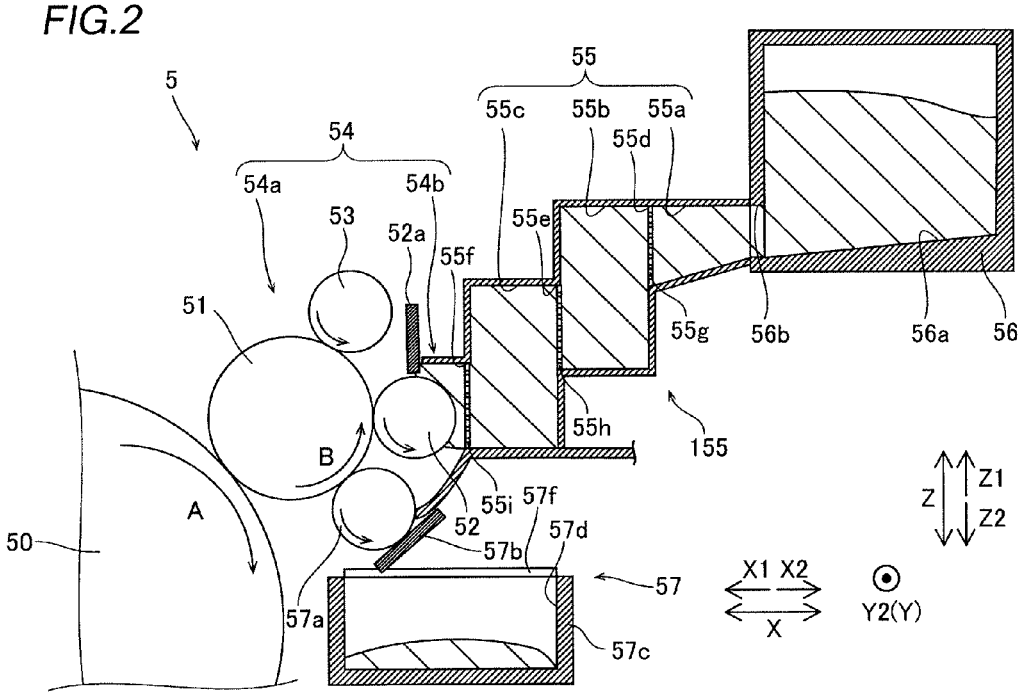
FIG. 2 illustrates a developing apparatus of the image forming apparatus according to the first embodiment of the present invention.

The developing roller 51 is negatively charged, and arranged to be opposed to the photosensitive drum 50, as shown in FIG. 2. At the time of printing, toner supplied by the supply roller 52 first adheres substantially to the whole of the developing roller 51 along a rotational direction B thereof. Then, the restriction roller 53 restricts the thickness of the toner adhering to the developing roller 51 to a prescribed level. The toner adhering to the developing roller 51 thereafter adheres to the electrostatic latent image formed on the photosensitive drum 50. After a recovery roller 57*a* of the old toner recovery portion 57 recovers toner remaining on the surface of the developing roller 51, the supply roller 52 supplies new toner again. The developing roller 51 removes most of the negative charge of the toner adhering thereto.

If positively charged old toner adheres to the developing roller 51, this toner adheres to a region of the photosensitive drum 50 other than that forming the electrostatic latent image. Thus, the toner adheres to a region of the printing paper 1 irrelevant to the electrostatic latent image, to cause smudging (scumming) in the printing paper 1.

An electrode 52*a* for charging the supply roller 52 thereby sticking sufficient toner thereto is arranged above the supply roller 52.

The toner carrying region 54 includes a roller region 54*a*, positioned closer to the photosensitive drum 50 (along arrow X1), where the developing roller 51, the supply roller 52 and the restriction roller 53 are arranged and a toner region 54*b*, positioned closer to the toner cartridge 56 (along arrow X2), where the toner adhering to the supply roller 52 is positioned. The toner region 54*b* is connected with the toner supply passage 55 on the side closer to the toner cartridge 56.

The toner supply passage 55 is configured to move the new toner fed from the toner cartridge 56 toward the toner carrying region 54 and to supply the same to the toner region 54*b* of the toner carrying region 54.

According to the first embodiment, the toner supply passage 55 is so configured that a passage portion 55*a*, a first chamber 55*b* and a second chamber 55*c* are arranged in this order from the side closer to the toner cartridge 56 (along arrow X2) toward the side closer to the toner carrying region 54 (along arrow X1). The passage portion 55*a* is connected with the toner cartridge 56 along arrow X2. The first chamber 55*b* is connected with the toner cartridge 56 through the passage portion 55*a* along arrow X2. The second chamber 55*c* is connected with the first chamber 55*b* along arrow X2, and connected with the toner region 54*b* of the toner carrying region 54 along arrow X1. The first chamber 55*b* is positioned below the passage portion 55*a* (along arrow Z2), while the second chamber 55*c* is arranged to be positioned below the first chamber 55*b*. Consequently, the passage portion 55*a*, the first chamber 55*b* and the second chamber 55*c* form a stepwise structure 155 so stepwisely connected that the height position descends toward the toner carrying region 54.

The passage portion 55*a* is so configured that the lower surface thereof is inclined downward along arrow X1. Thus, the new toner fed from the toner cartridge 56 to the passage portion 55*a* is naturally supplied to the first chamber 55*b* by the own weight thereof.

The first chamber 55*b* is connected with the passage portion 55*a* on a connectional portion 55*d* consisting of an opening formed in an upper portion (along arrow Z1) of a side surface along arrow X2, and connected with the second chamber 55*c* on another connectional portion 55*e* consisting of an opening formed in a lower portion (along arrow Z2) of a side surface along arrow X1. The second chamber 55*c* is connected with the toner region 54*b* of the toner carrying region 54 on a connectional portion 55*f* consisting of an opening formed in a lower portion of a side surface along arrow X1.

Figure 3:
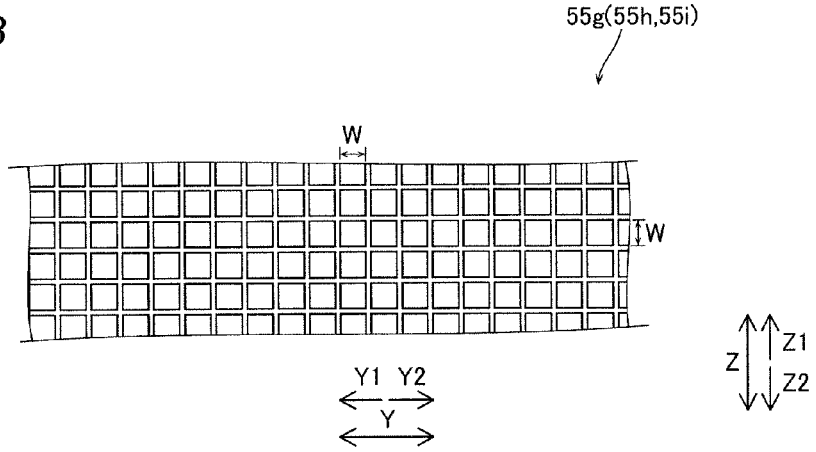
FIG. 3 illustrates a mesh member of the developing apparatus of the image forming apparatus according to the first embodiment of the present invention.

Mesh members 55*g*, 55*h* and 55*i* arranged to extend along the height direction (direction Z) are arranged on the connectional portions 55*d*, 55*e* and 55*f* respectively. The mesh member 55*g* separates the passage portion 55*a* and the first chamber 55*b* from each other. The mesh member 55*h* separates the first chamber 55*b* and the second chamber 55*c* from each other. The mesh member 55*i* separates the second chamber 55*c* and the toner region 54*b* from each other. Each of the mesh members 55*g*, 55*h* and 55*i* is meshed over the whole as shown in FIG. 3, and has a mesh width W larger than the average particle diameter of the toner. The mesh members 55*g* and 55*h* are examples of the "barrier portion" in the present invention.

Consequently, the toner fed from the toner cartridge 56 is naturally supplied to the passage portion 55*a*, the first chamber 55*b* and the second chamber 55*c* by the own weight thereof according to the first embodiment, as shown in FIG. 2. On the other hand, the passage portion 55*a*, the first chamber 55*b* and the second chamber 55*c* stepwisely connected with each other constitute the stepwise structure 155 preventing the toner from backflowing toward the toner cartridge 56. The stepwise structure 155 is an example of the "backflow prevention portion" in the present invention.

According to the first embodiment, the mesh members 55*g*, 55*h* and 55*i* have functions of preventing the old toner increased in particle diameter due to agglomeration from backflowing toward the toner cartridge 56 (along arrow X2). In other words, the mesh member 55*g* is configured to prevent the old toner from backflowing from the first chamber 55*b* toward the passage portion 55*a*. The mesh member 55*h* is configured to prevent the old toner from backflowing from the second chamber 55*c* toward the first chamber 55*b*. The mesh member 55*i* is configured to prevent the old toner from backflowing from the toner region 54*b* toward the second chamber 55*c*. The mesh members 55*g*, 55*h* and 55*i* are examples of the "backflow prevention portion" in the present invention.

The toner cartridge 56 includes a storage portion 56*a* storing new toner and an opening 56*b* provided on a lower portion (along arrow Z2) of a side surface along arrow X1 and connected to the passage portion 55*a*, and is configured to feed the new toner to the passage portion 55*a* of the toner supply passage 55. Further, the toner cartridge 56 is configured to be detachable from the image forming apparatus 100 (see FIG. 1) along a direction (direction Y) perpendicular to the plane of FIG. 2.

The old toner recovery portion 57 includes a recovery roller 57*a* arranged to be opposed to the developing roller 51, a blade portion 57*b* for scraping away the toner adhering to the recovery roller 57*a* by coming into contact with the recovery roller 57*a* and a box-type old toner recovery member 57*c* arranged under the recovery roller 57*a* and the blade portion 57*b*. The blade portion 57*b* is arranged under the toner region 54*b* (along arrow Z2) and under the recovery roller 57*a* along arrow X2. The old toner recovery member 57*c* is configured to be extractable from the image forming apparatus 100 along the direction (direction Y) perpendicular to the plane of FIG. 2.

Figure 4:
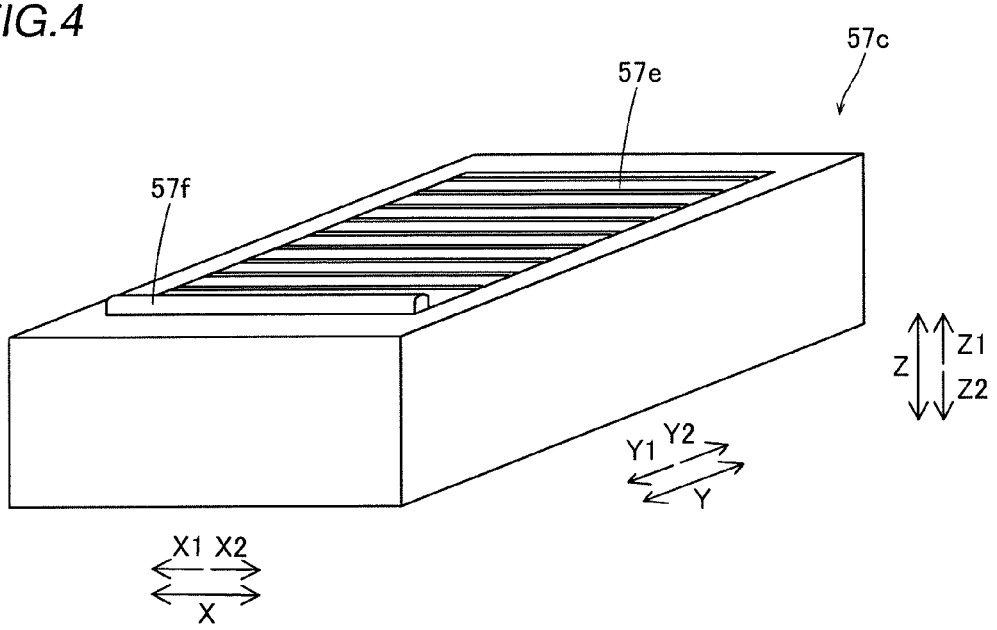
FIG. 4 is a perspective view showing an old toner recovery member of the developing apparatus of the image forming apparatus according to the first embodiment of the present invention.
Figure 5:
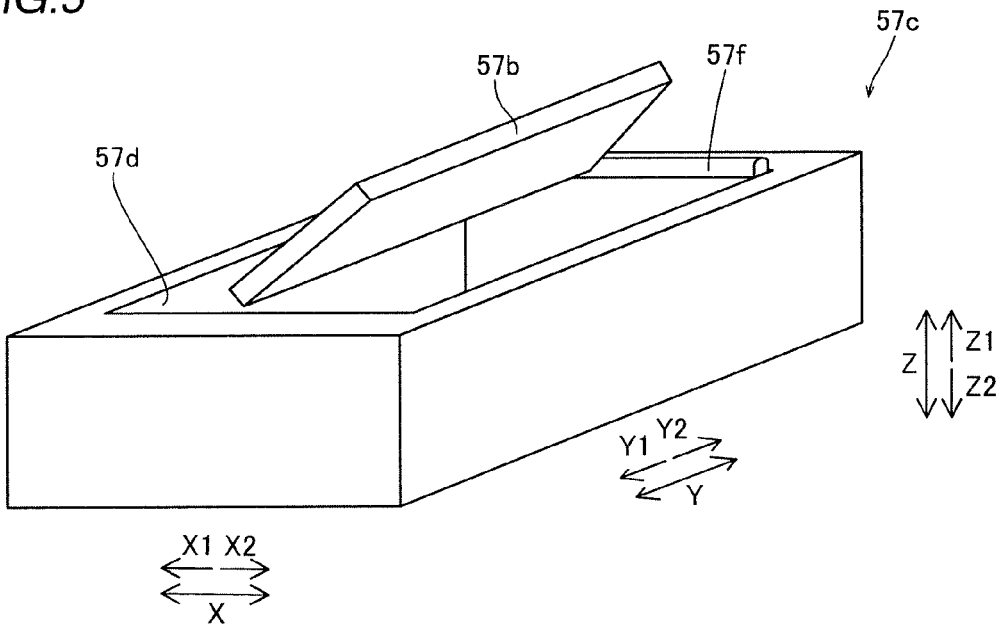
FIG. 5 is a perspective view showing a state where a shutter portion opens in the old toner recovery member of the developing apparatus of the image forming apparatus according to the first embodiment of the present invention.

As shown in FIG. 4, the old toner recovery member 57*c* has a storage portion 57*d* storing the old toner and a shutter portion 57*e* provided on the upper surface of the old toner recovery member 57*c*. The shutter portion 57*e* has a protrusion 57*f* projecting upward, and is urged along arrow Y1. The old toner recovery member 57*c* is so configured that the blade portion 57*b* comes into contact with the protrusion 57*f* so that the shutter portion 57*e* (see FIG. 4) opens to expose the storage portion 57*d* when the old toner recovery member 57*c* is mounted on the image forming apparatus 100, as shown in FIG. 5. Further, the old toner recovery member 57*c* is so configured that shutter portion 57*e* automatically closes due to urging force along arrow Y1 not to expose the storage portion 57*d* when the old toner recovery member 57*c* is extracted from the image forming apparatus 100, as shown in FIG. 4. Thus, the old toner stored in the storage portion 57*d* can be prevented from flying up into the air when the old toner recovery member 57*c* is extracted from the image forming apparatus 100.

The image forming apparatus 100 is configured to enter an old toner recovery mode for performing an old toner recovery operation when detecting that the toner cartridge 56 is almost empty and must be replaced with a new one. The image forming apparatus 100 is configured to drive the developing roller 51, the supply roller 52 and the recovery roller 57*a* by a prescribed time for recovering the old toner positioned in the toner supply passage 55 and the toner carrying region 54 into the storage portion 57*d* of the old toner recovery member 57*c* through the supply roller 52, the developing roller 51, the recovery roller 57*a* and the blade portion 57*b* in the old toner recovery operation.

According to the first embodiment, as hereinabove described, the toner supply passage 55 is provided with the stepwise structure 155 and the mesh members 55*g*, 55*h* and 55*i* for preventing the old toner from backflowing toward the toner cartridge 56. Thus, the stepwise structure 155 and the mesh members 55*g*, 55*h* and 55*i* prevent the old toner remaining in the toner supply passage 55 and the toner carrying region 54 from backflowing toward the toner cartridge 56 and coming into contact with the new toner fed from the toner cartridge 56, whereby the old toner can be prevented from adhering to the region of the photosensitive drum 50 where no electrostatic latent image is formed. Consequently, the toner can be prevented from adhering to the region of the printing paper 1 irrelevant to the electrostatic latent image, whereby the printing paper 1 can be prevented from smudging (scumming).

According to the first embodiment, the bottom surface of the second chamber 55*c* is arranged to be positioned below the bottom surface of the first chamber 55*b* so that the old toner can be more reliably prevented from backflowing from the second chamber 55*c* toward the first chamber 55*b* due to the own weight thereof, whereby the old toner remaining in the second chamber 55*c* can be more reliably prevented from backflowing toward the first chamber 55*b* and coming into contact with the new toner present in the first chamber 55*b*.

According to the first embodiment, the toner supply passage 55 is formed in the stepwise structure 115 so stepwisely connected that the height position descends toward the toner carrying region 54 by the bottom surfaces of the first and second chambers 55*b* and 55*c*. Thus, the old toner can be effectively prevented from backflowing from the second chamber 55*c* toward the first chamber 55*b* due to the own weight thereof, whereby the old toner remaining in the second chamber 55*c* can be effectively prevented from backflowing toward the first chamber 55*b* and coming into contact with the new toner present in the first chamber 55*b*.

According to the first embodiment, the mesh members 55*g*, 55*h* and 55*i* are configured to prevent the old toner increased in particle diameter due to agglomeration from backflowing toward the toner cartridge 56, whereby the mesh members 55*g*, 55*h* and 55*i* can easily prevent the old toner remaining in the toner supply passage 55 and the toner carrying region 54 from backflowing toward the toner cartridge 56.

According to the first embodiment, the passage portion 55*a* and the first and second chambers 55*b* and 55*c* form the stepwise structure 155 so stepwisely connected that the height position descends toward the toner carrying region 54, whereby the toner can be easily supplied toward the toner carrying region 54 due to the own weight thereof while the old toner can be prevented from backflowing from the toner carrying region 54 toward the toner cartridge 56.

According to the first embodiment, the mesh members 55*g*, 55*h* and 55*i* have the mesh width W larger than the average particle diameter of the toner, whereby the same can reliably prevent the old toner increased in particle diameter due to agglomeration from backflowing toward the toner cartridge 56 while reliably supplying toner of not more than the average particle diameter to the toner carrying region 54.

According to the first embodiment, the developing apparatus 5 is provided with the old toner recovery portion 57 for recovering the old toner adhering to the developing roller 51 to be capable of preventing remarkably deteriorated old toner almost losing charge due to charge removal in the developing roller 51 from returning to the toner carrying region 54, whereby the remarkably deteriorated old toner can be reliably prevented from coming into contact with the new toner.

According to the first embodiment, the image forming apparatus 100 is configured to enter the old toner recovery mode for performing the old toner recovery operation when determining that the toner cartridge 56 must be replaced with a new toner cartridge 56 so that the same can recover the old toner before the new toner cartridge 56 supplies new toner, whereby the old toner can be reliably prevented from coming into contact with the new toner.

According to the first embodiment, the old toner recovery portion 57 recovers the old toner adhering to the developing roller 51 so that the photosensitive drum 50 may not stick the old toner thereto for recovering the same in the cleaning portion 59, whereby the number of times of sticking the toner to the photosensitive drum 50 can be reduced. Thus, the photosensitive drum 50 can be prevented from deterioration in an early stage.

According to the first embodiment, the old toner recovery portion 57 includes the old toner recovery member 57*c*, which in turn is provided with the storage portion 57*d* formed inside the old toner recovery member 57*c* for storing the old toner and the shutter portion 57*e* formed on the upper surface thereof, and the shutter portion 57*e* is configured to expose the storage portion 57*d* from the upper surface of the old toner recovery member 57*c* by opening when the old toner recovery member 57*c* is mounted on the image forming apparatus 100 and not to expose the storage portion 57*d* from the upper surface of the old toner recovery member 57*c* by closing when the old toner recovery member 57*c* is detached from the image forming apparatus 100. Thus, the shutter portion 57*e* can prevent the old toner stored in the storage portion 57*d* from flying up into the air when the old toner recovery member 57*c* is extracted from the image forming apparatus 100.

According to the first embodiment, the old toner recovery portion 57 includes the blade portion 57*b* arranged in the developing apparatus 5 for recovering the old toner, while the shutter portion 57*e* has the protrusion 57*f* projecting upward, is so configured that the protrusion 57*f* and the blade portion 57*b* come into contact with each other so that the shutter portion 57*e* opens when the old toner recovery member 57*c* is mounted on the image forming apparatus 100, and configured to close due to urging force applied thereto in a direction where the shutter 57*e* closes when the old toner recovery member 57*c* is detached from the image forming apparatus 100. Thus, the shutter portion 57*e* is easily openable through the blade portion 57*b* when the old toner recovery member 57*c* is mounted on the image forming apparatus 100, and easily closable when the old toner recovery member 57*c* is detached from the image forming apparatus 100.

According to the first embodiment, the plurality of mesh members 55*g*, 55*h* and 55*i* are so configured that the height positions thereof descend toward the toner carrying region 54. Thus, the mesh members 55*g*, 55*h* and 55*i* can prevent the old toner remaining in the toner supply passage 55 and the toner carrying region 54 from backflowing toward the toner cartridge 56, while the new toner can be supplied toward the mesh member 55*i* having the smallest height position among the plurality of mesh members 55*g*, 55*h* and 55*i* due to the own weight thereof.

(Modification of First Embodiment)

A developing apparatus 205 according to a modification of the first embodiment of the present invention is now described with reference to FIG. 6. According to the modification of the first embodiment of the present invention, a mesh member 255*g* is inclinedly arranged, dissimilarly to the aforementioned first embodiment.

Figure 6:
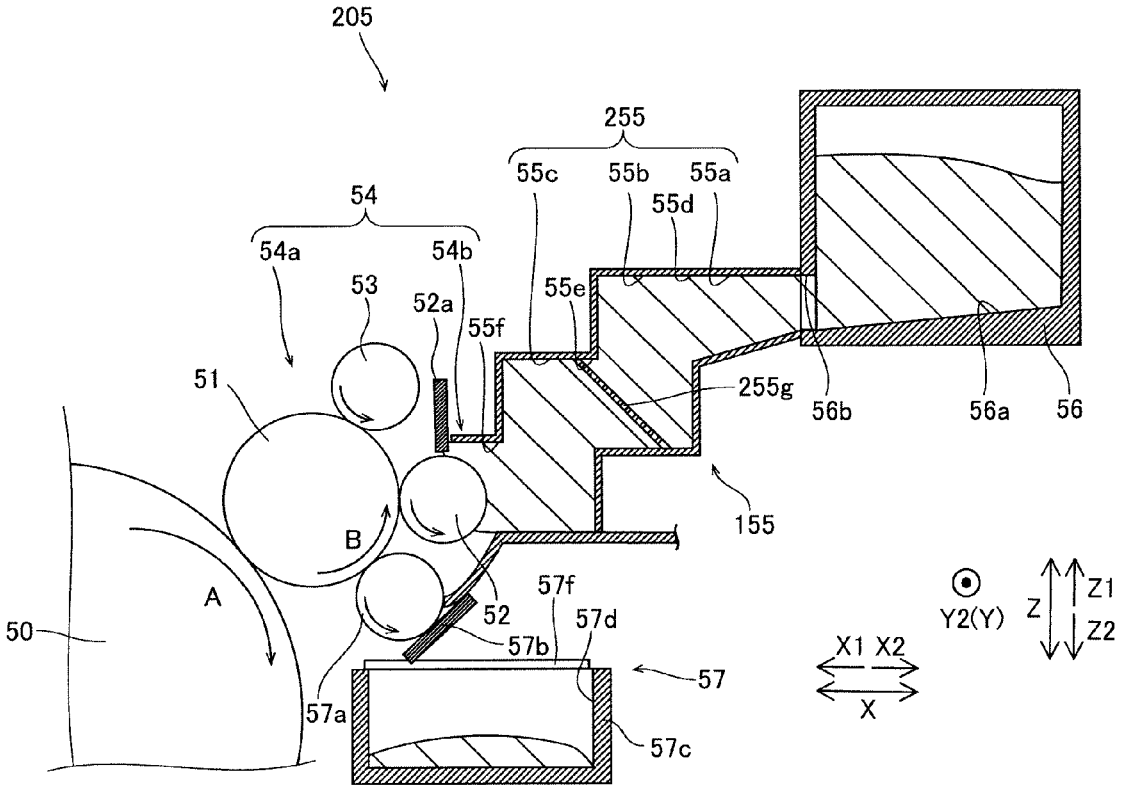
FIG. 6 illustrates a developing apparatus according to a modification of the first embodiment of the present invention.

According to the modification of the first embodiment, the mesh member 255*g* is arranged substantially at the center of a toner supply passage 255 of the developing apparatus 205 in a direction X in an inclined state (state arranged to intersect with a direction Z) as shown in FIG. 6, dissimilarly to the aforementioned first embodiment (see FIG. 2) in which the mesh members 55*g*, 55*h* and 55*i* are arranged to extend along the height direction (direction Z) respectively. More specifically, the mesh member 255*g* is arranged in a state so inclined that that the upper end (along arrow Z1) thereof is closer to a toner carrying region 54 (along arrow X1) and the lower end (along arrow Z2) thereof is closer to a toner cartridge 56 (along arrow X2). The mesh member 255*g* partitions the toner supply passage 255 into portions along arrows X1 and X2. The mesh member 255*g* has a function of preventing old toner from backflowing toward the toner cartridge 56. The mesh member 255*g* is an example of the "barrier portion" or the "backflow prevention portion" in the present invention.

The remaining structure of the modification of the first embodiment is similar to that of the aforementioned first embodiment.

Also in the structure according to the modification of the first embodiment, as hereinabove described, the toner supply passage 255 is provided with the mesh member 255*g* for preventing the old toner from backflowing toward the toner cartridge 56 similarly to the aforementioned first embodiment, whereby a printing paper can be prevented from smudging (scumming).

According to the modification of the first embodiment, the mesh member 255*g* is arranged on the toner supply passage 255 in the state so inclined that the upper end thereof is closer to the toner carrying region 54 and the lower end thereof is closer to the toner cartridge 56. Thus, it follows that toner present in a portion closer to the toner cartridge 56 is positioned above the inclinedly arranged mesh member 255*g* while that present in a portion closer to the toner carrying region 54 is positioned below the inclinedly arranged mesh member 255*g*, whereby the toner can be easily supplied toward the toner carrying region 54 due to the own weight thereof, and can be prevented from backflowing from the toner carrying region 54 toward the toner cartridge 56. The remaining effects of the modification of the first embodiment are similar to those of the aforementioned first embodiment.

(Second Embodiment)

A developing apparatus 305 according to a second embodiment of the present invention is now described with reference to FIGS. 7 to 11. According to the second embodiment, a toner supply passage 355 is deformable, dissimilarly to the aforementioned first embodiment.

Figure 7:
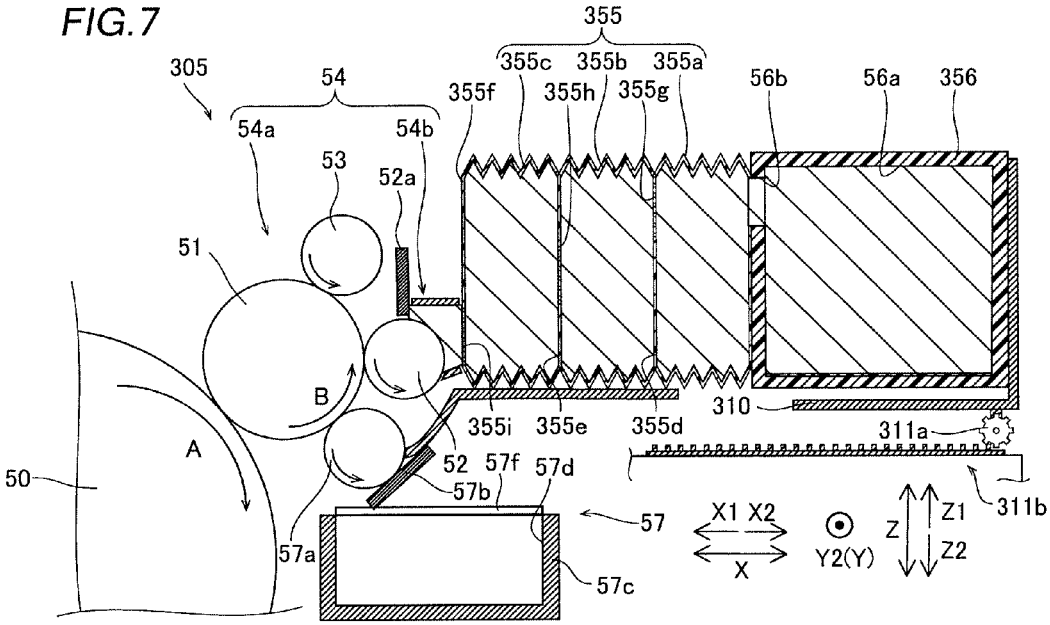
FIG. 7 illustrates a developing apparatus according to a second embodiment of the present invention.

According to the second embodiment, the toner supply passage 355 supplying toner to a toner carrying region 54 and a toner cartridge 356 storing new toner are integrally provided on the developing apparatus 305, and configured to be detachable therefrom, as shown in FIG. 7.

In the toner supply passage 355, a first chamber 355*a*, a second chamber 355*b* and a third chamber 355*c* are arranged in this order from a side closer to the toner cartridge 356 (along arrow X2) toward the side of the toner carrying region 54 (along arrow X1). The first chamber 355*a* is connected with the toner cartridge 356 along arrow X2. The second chamber 355*b* is connected with the first chamber 355*a* along arrow X2. The third chamber 355*c* is connected with the second chamber 355*b* along arrow X2, and connected with a toner region 54*b* of the toner carrying region 54 along arrow X1. The toner cartridge 356 and the first to third chambers 355*a*, 355*b* and 355*c* are arranged to be flush with each other.

Barrier portions 355*d*, 355*e* and 355*f* are arranged between the first chamber 355*a* and the second chamber 355*b*, between the second chamber 355*b* and the third chamber 355*c* and between the third chamber 355*c* and the toner region 54*b* respectively.

According to the second embodiment, the first to third chambers 355*a*, 355*b* and 355*c* and the toner cartridge 356 are formed by deformable members of PET resin or the like, and so configured that the volumes thereof are reduced by deformation. More specifically, all of the first to third chambers 355*a*, 355*b* and 355*c* are provided with bellows structures expandable/contractable in a direction X on the upper and lower surfaces thereof, and configured to be so elastically deformable that the volumes thereof are reduced toward the toner carrying region 54.

According to the second embodiment, members constituting the toner supply passage 355 and the toner cartridge 356 are configured to be softer in order of the third chamber 355*b*, the second chamber 355*b*, the first chamber 355*a* and the toner cartridge 356. Thus, the toner cartridge 356 deforms with the smallest force, the first chamber 355*a* deforms with force smaller than that for the second and third chambers 355*b* and 355*c*, the second chamber 355*b* deforms with force smaller than that for the third chamber 355*c*, and the third chamber 355*c* is configured to be most undeformable.

A mesh member 355*g* is arranged on an opening formed in an upper portion (along arrow Z1) of the barrier portion 355*d* for connecting the first and second chambers 355*a* and 355*b* with each other. A mesh member 355*h* is arranged on an opening formed substantially at the center of the barrier portion 355*e* for connecting the second and third chambers 355*b* and 355*c* with each other. A mesh member 355*i* is arranged on an opening formed in a lower portion (along arrow Z2) of the barrier portion 355*f* for connecting the third chamber 355*c* and the toner region 54*b* with each other.

The toner cartridge 356 is placed on a receiving member 310 having an L-shaped section. A rotationally drivable gear 311*a* is provided under the receiving member 310. A pinion 311*b* extending in the direction X is provided on a position meshable with the gear 311*a*. Thus, the gear 311*a* is rotationally driven to move on the pinion 311*b* along arrow X1, so that the receiving member 310 moves to press the toner supply passage 355 and the toner cartridge 356 toward the toner carrying region 54 (along arrow X1). The receiving member 310 is an example of the "pressing portion" in the present invention. The gear 311*a* and the pinion 311*b* are examples of the "driving mechanism" in the present invention.

Consequently, toner supplied to the first chamber 355*a* is further supplied to the second chamber 355*b* due to pressing force of the receiving member 310, while old toner is prevented from backflowing toward the toner cartridge 356. The toner supplied to the second chamber 355*b* is further supplied to the third chamber 355*c* due to the pressing force of the receiving member 310, while old toner is prevented from backflowing toward the first chamber 355*a*. The toner supplied to the third chamber 355*c* is further supplied to the toner region 54*b* of the toner carrying region 54 due to the pressing force of the receiving member 310, while old toner is prevented from backflowing toward the second chamber 355*b*. The receiving member 310 is an example of the "backflow prevention portion" in the present invention.

According to the second embodiment, the barrier portion 355*d* prevents the old toner from backflowing from the second chamber 355*b* toward the first chamber 355*a*. The barrier portion 355*e* prevents the old toner from backflowing from the third chamber 355*c* toward the second chamber 355*b*. The barrier portion 355*f* prevents the old toner from backflowing from the toner region 54 toward the third chamber 355*c*. The barrier portions 355*d*, 355*e* and 355*f* are examples of the "backflow prevention portion" in the present invention.

The remaining structure of the second embodiment is similar to that of the aforementioned first embodiment.

A toner supply operation through the toner supply passage 355 and the toner cartridge 356 according to the second embodiment is now described with reference to FIGS. 7 to 11.

First, the gear 311*a* is rotationally driven from the state shown in FIG. 7 to gradually move on the pinion 311*b* toward the toner carrying region 54 (along arrow X1), thereby moving the receiving member 310 along arrow X1. Thus, the receiving member 310 applies the pressing force to the toner supply passage 355 and the toner cartridge 356 along arrow X1. Therefore, the toner cartridge 356 deformable with the smallest force first starts to deform along arrow X1 so that the volume thereof is reduced. At this time, the toner is supplied from the toner supply passage 355 and the toner cartridge 356 to the toner region 54*b* through the mesh members 355*g*, 355*h* and 355*i*, due to the deformation of the toner cartridge 356. On the other hand, the barrier portions 355*d*, 355*e* and 355*f* prevent the toner from backflowing toward the toner cartridge 356.

Figure 8:
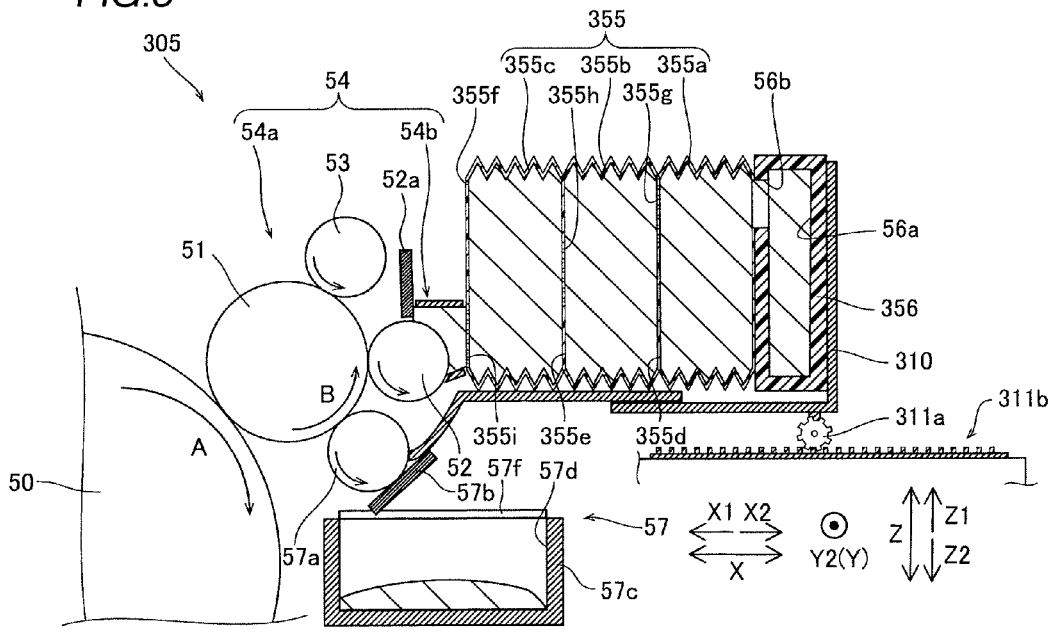
FIG. 8 illustrates a state where a toner cartridge deforms in the developing apparatus according to the second embodiment of the present invention.
Figure 9:
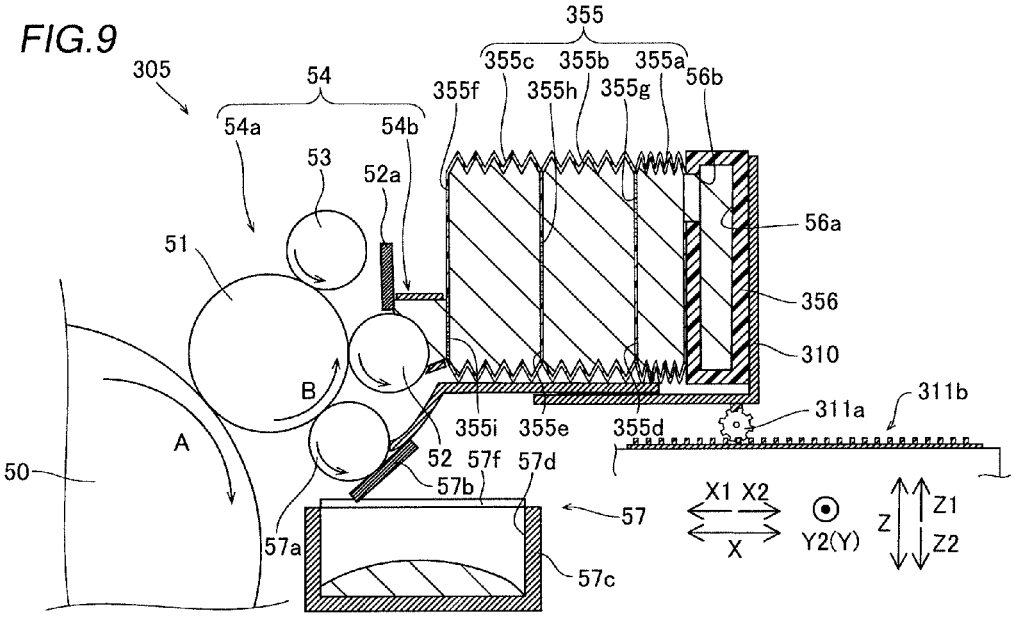
FIG. 9 illustrates a state where a first chamber deforms in the developing apparatus according to the second embodiment of the present invention.
Figure 10:
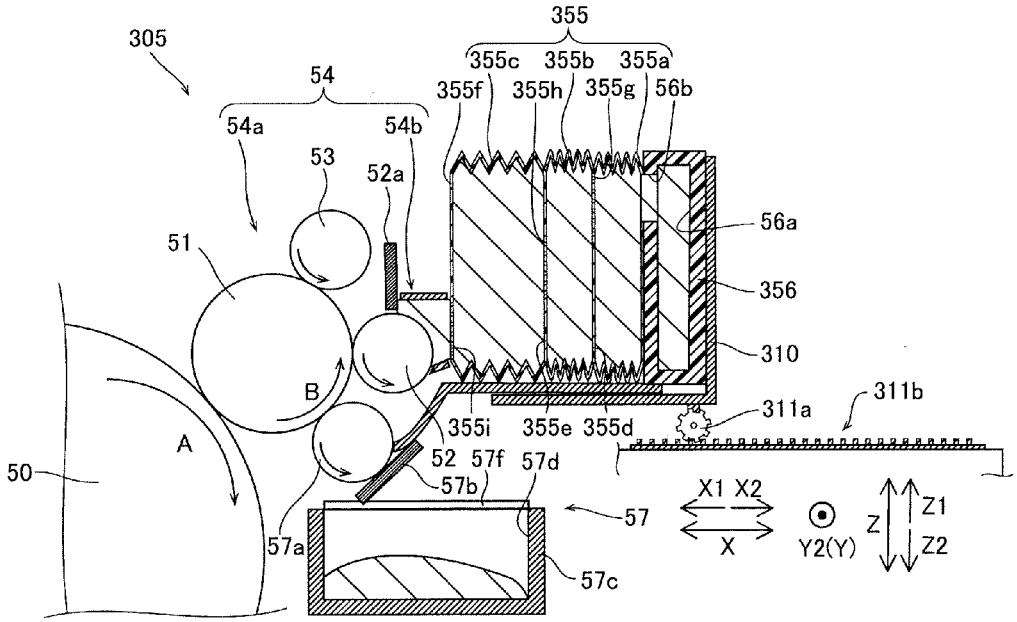
FIG. 10 illustrates a state where a second chamber deforms in the developing apparatus according to the second embodiment of the present invention.

After the toner cartridge 356 sufficiently deforms in the direction X, the first chamber 355*a* deformable with the force smaller than that for the toner cartridge 356 starts to deform along arrow X1 so that the volume thereof is reduced, as shown in FIG. 8. After the first chamber 355*a* sufficiently deforms in the direction X, the second chamber 355*b* deformable with the force smaller than that for the first chamber 355*a* starts to deform along arrow X1 so that the volume thereof is reduced, as shown in FIG. 9. After the second chamber 355*b* sufficiently deforms in the direction X, the most undeformable third chamber 355*c* finally starts to deform along arrow X1 so that the volume thereof is reduced, as shown in FIG. 10. At this time, the toner is supplied from the toner supply passage 355 to the toner region 54*b* through the mesh members 355*g*, 355*h* and 355*i*, due to the deformation of the toner supply passage 355. On the other hand, the barrier portions 355*d*, 355*e* and 355*f* prevent the toner from backflowing toward the toner cartridge 356.

Figure 11:
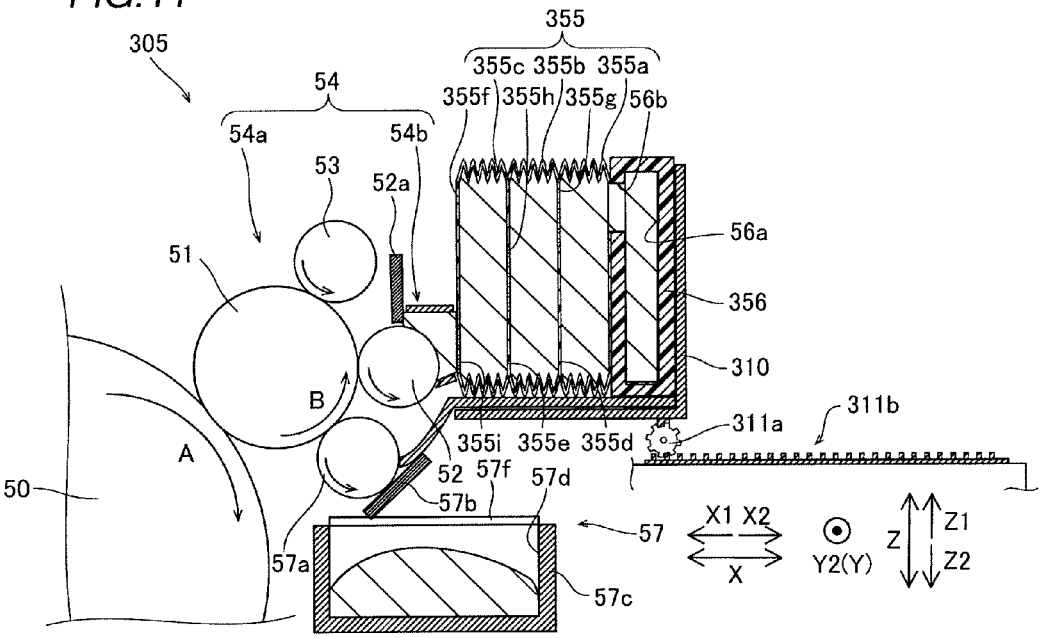
FIG. 11 illustrates a state where a toner supply passage and a toner cartridge entirely deform in the developing apparatus according to the second embodiment of the present invention.

Thereafter the developing apparatus 305 determines that the toner cartridge 356 must be replaced with a new one when detecting that the toner supply passage 355 and the toner cartridge 356 entirely deform as shown in FIG. 11, and performs an old toner recovery operation. Then, the toner supply passage 355 and the toner cartridge 356 are integrally replaced with new ones.

Also in the structure according to the second embodiment, as hereinabove described, the toner supply passage 355 is provided with the receiving member 310 and the barrier portions 355*d*, 355*e* and 355*f* for preventing the old toner from backflowing toward the toner cartridge 356 (along arrow X2), similarly to the aforementioned first embodiment. Thus, a printing paper can be prevented from smudging (scumming).

According to the second embodiment, the developing apparatus 305 further includes the rotationally drivable gear 311*a* and the pinion 311*b* for pressing at least either the deformable first chamber 355*a* or the deformable second chamber 355*b* toward the toner carrying region 54 (along arrow X1). Thus, the rotationally drivable gear 311*a* and the pinion 311*b* can control the pressing force of the receiving member 310, whereby the toner can be reliably supplied toward the toner carrying region 54.

According to the second embodiment, the first to third chambers 355*a*, 355*b* and 355*c* and the toner cartridge 356 are so configured that the volumes thereof are reduced by deformation, while the receiving member 310 is configured to be capable of pressing the first to third chambers 355*a*, 355*b* and 355*c* and the toner cartridge 356 toward the toner carrying region 54 (along arrow X1). Thus, the receiving member 310 can supply pressing force to the toner for moving the same toward the toner carrying region 54, whereby the toner can be easily supplied toward the toner carrying region 54, while the old toner can be prevented from backflowing toward the toner cartridge 56.

According to the second embodiment, the first to third chambers 355*a*, 355*b* and 355*c* are configured to have the bellows structures so elastically deformable that the volumes thereof are reduced toward the toner carrying region 54. Thus, the first to third chambers 355*a*, 355*b* and 355*c* can easily supply the pressing force to the toner for moving the same toward the toner carrying region 54, whereby the toner can be easily supplied toward the toner carrying region 54.

According to the second embodiment, the first chamber 355*a* is configured to deform with the force smaller than that for the second chamber 355*b* so that the second chamber 355*b* closer to the toner carrying region 54 can be deformed after deformation of the first chamber 355*a* closer to the toner cartridge 356, whereby the developing apparatus 305 can be prevented from formation of force backflowing the toner from the second chamber 355*b* toward the first chamber 355*a* due to preceding deformation of the second chamber 355*b*.

The remaining effects of the second embodiment are similar to those of the aforementioned first embodiment.

(First Modification of Second Embodiment)

A developing apparatus 405 according to a first modification of the second embodiment of the present invention is now described with reference to FIG. 12. In the developing apparatus 405 according to the first modification of the second embodiment, a toner supply passage 455 is formed to be gradually narrowing from a side closer to a toner cartridge 356 toward a side closer to a toner carrying region 54, dissimilarly to the aforementioned second embodiment.

Figure 12:
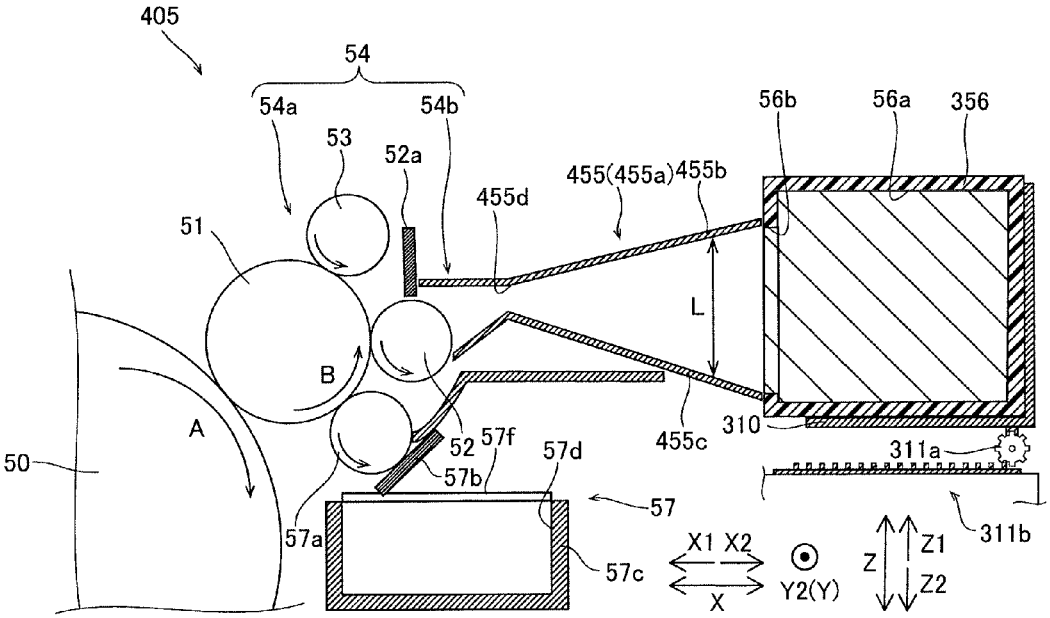
FIG. 12 illustrates a developing apparatus according to a first modification of the second embodiment of the present invention.

According to the first modification of the second embodiment, the toner supply passage 455 of the developing apparatus 405 is not configured to be deformable dissimilarly to the toner supply passage 355 (see FIG. 7) according to the aforementioned second embodiment, as shown in FIG. 12. Further, the toner supply passage 455 is provided with an inclined structure 455*a*. The inclined structure 455*a* is so configured that an upper surface 455*b* is inclined downward (along arrow Z2) from the side closer to the toner cartridge 356 (along arrow X2) toward the toner carrying region 54 (along arrow X1) while a lower surface 455*c* is inclined upward (along arrow Z1). Thus, a length L of the inclined structure 455*a* in the height direction (direction Z) is gradually reduced along arrows X2 and X1, whereby the inclined structure 455*a* of the toner supply passage 455 is formed to be gradually narrowing from the side closer to the toner cartridge 356 (along arrow (X2) toward the toner carrying region 54 (along arrow X1).

The inclined structure 455*a* is configured to be narrowest in a connectional portion 455*d* between the inclined structure 455*a* and the toner carrying region 54. A toner region 54*b* of the toner carrying region 54 is configured to spread from the connectional portion 455*d* along arrow X1. Consequently, the inclined structure 455*a* including the connectional portion 455*d* prevents old toner present in the toner region 54*b* from backflowing toward the toner cartridge 356. The inclined structure 455*a* is an example of the "backflow prevention portion" in the present invention.

The remaining structure of the first modification of the second embodiment is similar to that of the aforementioned second embodiment.

Also in the structure according to the first modification of the second embodiment, as hereinabove described, the toner supply passage 455 is provided with the inclined structure 455*a* for preventing the old toner from backflowing toward the toner cartridge 356 similarly to the aforementioned first embodiment, whereby a printing paper can be prevented from smudging (scumming).

According to the first modification of the second embodiment, further, the inclined structure 455*a* of the toner supply passage 455 is formed to gradually narrow from the side closer to the toner cartridge 356 toward the toner carrying region 54 to be capable of limiting the quantity of toner backflowing from the toner carrying region 54 on the narrowest position (connectional portion 455*d*) thereof, whereby the same can prevent the toner from backflowing from the toner carrying region 54 toward the toner cartridge 356.

The remaining effects of the first modification of the second embodiment are similar to those of the aforementioned first embodiment.

(Second Modification of Second Embodiment)

A developing apparatus 505 according to a second modification of the second embodiment of the present invention is now described with reference to FIG. 13. According to the second modification of the second embodiment, a toner supply passage 555 is provided with a lid member 555*e*, in addition to the structure according to the first modification of the aforementioned second embodiment.

Figure 13:
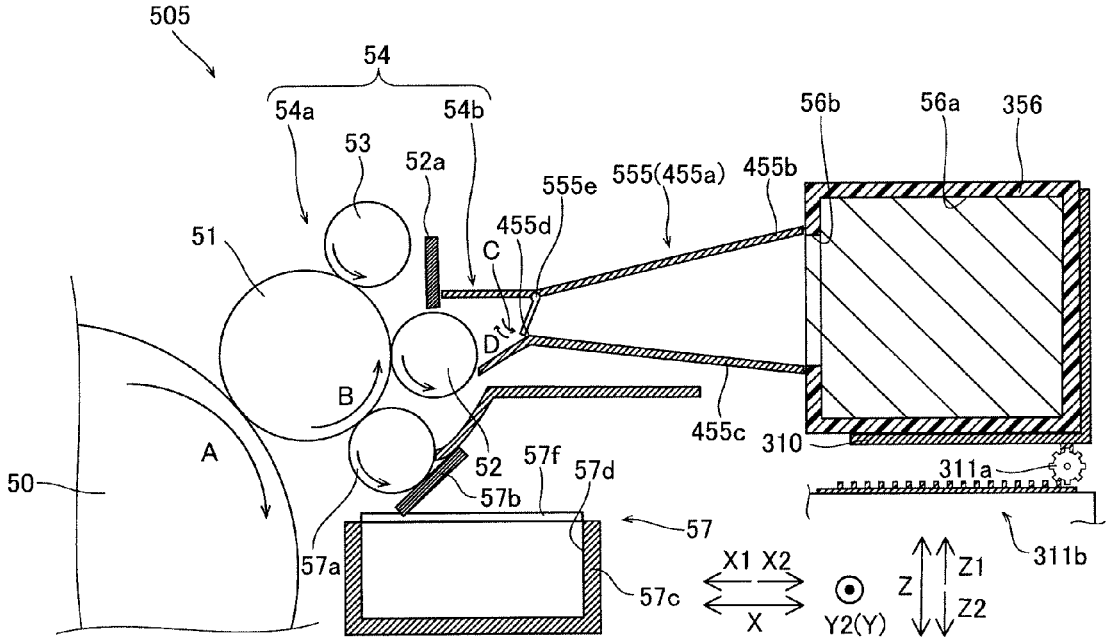
FIG. 13 illustrates a developing apparatus according to a second modification of the second embodiment of the present invention.

According to the second modification of the second embodiment, the lid member 555*e* is arranged on a connectional portion 455*d* of the toner supply passage 555 of the developing apparatus 505, as shown in FIG. 13. The lid member 555*e* is mounted on an upper surface 455*b* of the toner supply passage 555, to block the connectional portion 455*d*. The lid member 555*e* is urged toward a toner cartridge 356 (in a direction C), and so configured that the lower end thereof comes into contact with a lower surface 455*c* of the connectional portion 455*d*. Thus, the lid member 555*e* is configured to block the connectional portion 455*d* of the toner supply passage 555. The lid member 555*e* is an example of the "backflow prevention portion" in the present invention.

Thus, the lid member 555*e* is configured to prevent the old toner present in the toner region 54*b* of the toner carrying region 54 from backflowing toward the toner cartridge 356 by blocking the connectional portion 455*d*. On the other hand, a receiving member 310 applies pressing force against urging force acting on the lid member 555*e* to the toner present in the toner supply passage 555, so that the lid member 555*e* opens in a direction D. Thus, the toner is supplied from the toner supply passage 555 to the toner region 54*b*.

The remaining structure of the second modification of the second embodiment is similar to that of the first modification of the aforementioned second embodiment.

Also in the structure according to the second modification of the second embodiment, as hereinabove described, the toner supply passage 555 is provided with the lid member 555*e* for preventing the old toner from backflowing toward the toner cartridge 356, whereby a printing paper can be prevented from smudging (scumming).

According to the second modification of the second embodiment, the lid member 555*e* is urged toward the toner cartridge 356 (in the direction C), and so configured that the lower end thereof comes into contact with the lower surface 455*c* of the connectional portion 455*d*. Thus, the lid member 555*e* prevents the old toner from backflowing from the toner carrying region 54 toward the toner cartridge 356 by blocking the connectional portion 455, while the toner present in the toner supply passage 555 is supplied to the toner carrying region 54, whereby the toner can be easily supplied toward the toner carrying region 54, and can be prevented from backflowing toward the toner cartridge 356.

The remaining effects of the second modification of the second embodiment are similar to those of the first modification of the aforementioned second embodiment.

Although the present invention has been described and illustrated in detail, it is clearly understood that the same is by way of illustration and example only and is not to be taken by way of limitation, the spirit and scope of the present invention being limited only by the terms of the appended claims.

For example, while the first, second and third chambers 355*a*, 355*b* and 355*c* of the toner supply passage 355 are arranged to be flush with each other in the aforementioned second embodiment, the present invention is not restricted to this. According to the present invention, the second chamber may alternatively be arranged below the first chamber, and the third chamber may also be arranged below the second chamber, as in the aforementioned first embodiment. Thus, the toner can be further prevented from backflowing toward the toner cartridge due to the own weight thereof.

While the mesh member separates the first and second chambers from each other in the aforementioned first embodiment, the present invention is not restricted to this. The first and second chambers may alternatively be separated from each other by employing not the mesh member but a plate member provided with a plurality of through-holes. In this case, the diameter of the through-holes is preferably larger than the average particle diameter of the toner.

While the toner supply passage 55 is constituted of the passage portion 55*a* and the first and second chambers 55*b* and 55*c* in the aforementioned first embodiment, the present invention is not restricted to this. According to the present invention, a third chamber may be further arranged between the second chamber and the toner carrying region. The third chamber is preferably arranged to be positioned below the second chamber.

While the developing apparatus 305 is so configured that the toner cartridge 356 deforms with the smallest force, the first chamber 355*a* deforms with force smaller than that for the second and third chambers 355*b* and 355*c* and the second chamber 355*b* deforms with force smaller than that for the third chamber 355*c* in the aforementioned second embodiment, the present invention is not restricted to this. According to the present invention, the toner cartridge and the first to third chambers may alternatively be configured to so deform that the volumes thereof are reduced with the same force. Further alternatively, any one of the toner cartridge and the first to third chambers may be configured to be undeformable.

While the receiving member 310 is configured to press the toner supply passage 355 and the toner cartridge 356 toward the toner carrying region 54 (along arrow X1) through the rotationally drivable gear 311*a* and the pinion 311*b* extending in the direction X in the aforementioned second embodiment, the present invention is not restricted to this. The receiving member may alternatively be configured to press the toner supply passage and the toner cartridge toward the toner carrying region through an elastic member urged toward the toner carrying region, for example.

While the lid member is further provided on the toner supply passage according to the first modification of the aforementioned second embodiment in the second modification of the aforementioned second embodiment, the present invention is not restricted to this. The lid member may alternatively be provided on the toner supply passage 55 according to the aforementioned first embodiment, for example.

What is claimed is:

1. A developing apparatus comprising:

an image carrier where an electrostatic latent image is formed;

a toner carrier for supplying toner to the electrostatic latent image formed on the image carrier; and a toner supply passage for supplying toner fed from a toner cartridge to a toner carrying region where the toner carrier is arranged, wherein the toner supply passage is provided with a backflow prevention portion for preventing the toner from backflowing toward the toner cartridge, the backflow prevention portion has a structure that the height position descends toward the toner carrying region, the toner supply passage includes a first chamber connected to the toner cartridge and a second chamber connected to the first chamber and the toner carrying region, and the bottom surface of the second chamber is positioned below the bottom surface of the first chamber.

2. The developing apparatus according to claim 1, wherein the backflow prevention portion is configured to prevent the toner from backflowing from the second chamber toward the first chamber.

3. The developing apparatus according to claim 1, wherein the backflow prevention portion includes a barrier portion having a mesh member for preventing the toner from backflowing toward the toner cartridge.

4. The developing apparatus according to claim 1, wherein the toner supply passage has a stepwise structure so stepwisely connected that the height position descends toward the toner carrying region due to the bottom surface of the first chamber and the bottom surface of the second chamber.

5. The developing apparatus according to claim 1, wherein at least either the first chamber or the second chamber is configured to be so deformable that the volume is reduced, and the backflow prevention portion includes a pressing portion for pressing at least either deformable one of the first chamber and the second chamber toward the toner carrying region.

6. The developing apparatus according to claim 3, wherein the mesh member of the barrier portion has a mesh width larger than the average particle diameter of the toner.

7. The developing apparatus according to claim 3, wherein the mesh member of the barrier portion is arranged in a state so inclined that the upper end is closer to the toner carrying region.

8. The developing apparatus according to claim 1, wherein the backflow prevention portion of the toner supply passage has a structure gradually narrowing from a side closer to the toner cartridge toward the toner carrying region.

9. The developing apparatus according to claim 1, wherein the backflow prevention portion includes a lid member blocking the toner supply passage in a state urged toward the toner cartridge, and the lid member is configured to pass the toner toward the toner carrying region and to prevent the toner from backflowing toward the toner cartridge.

10. The developing apparatus according to claim 1, further comprising a toner recovery portion for recovering the toner adhering to the toner carrier.

11. The developing apparatus according to claim 10, configured to perform a toner recovering operation for recovering the toner into the toner recovery portion when the toner cartridge is to be replaced with a new toner cartridge.

12. The developing apparatus according to claim 10, wherein the toner recovery portion includes a toner recovery member, the toner recovery member includes a storage portion formed inside the toner recovery member for storing the toner and a shutter portion provided on the upper surface of the toner recovery member, and the shutter portion is configured to expose the storage portion from the upper surface of the toner recovery member by opening when the toner recovery member is mounted on the developing apparatus, and configured not to expose the storage portion from the upper surface of the toner recovery member by closing when the toner recovery member is detached from the developing apparatus.

13. The developing apparatus according to claim 3, wherein the backflow prevention portion includes a plurality of barrier portions provided with mesh members having height positions different from each other, and the plurality of barrier portions are so configured that the height positions of the mesh members descend toward the toner carrying region.

14. An image forming apparatus comprising a toner cartridge storing toner and a developing apparatus, wherein the developing apparatus includes:

an image carrier where an electrostatic latent image is formed;

a toner carrier for supplying toner to the electrostatic latent image formed on the image carrier; and a toner supply passage for supplying the toner fed from the toner cartridge to a toner carrying region where the toner carrier is arranged, and the toner supply passage of the developing apparatus is provided with a backflow prevention portion for preventing the toner from backflowing toward the toner cartridge, wherein the backflow prevention portion has a structure that the height position descends toward the toner carrying region, the toner supply passage includes a first chamber connected to the toner cartridge and a second chamber connected to the first chamber and the toner carrying region, and the bottom surface of the second chamber is positioned below the bottom surface of the first chamber.

15. An image forming apparatus according to claim 14, wherein the backflow prevention portion includes a barrier portion having a mesh member for preventing the toner from backflowing toward the toner cartridge.

16. A developing apparatus comprising:

an image carrier where an electrostatic latent image is formed;

a toner carrier for supplying toner to the electrostatic latent image formed on the image carrier; and a toner supply passage for supplying toner fed from a toner cartridge to a toner carrying region where the toner carrier is arranged, wherein the toner supply passage is provided with a backflow prevention portion for preventing the toner from backflowing toward the toner cartridge, the backflow prevention portion has a structure that the height position descends toward the toner carrying region, the toner supply passage includes a plurality of chambers each having a bottom surface between the toner cartridge and the toner carrying region, and the bottom surface of one chamber arranged toward a side of the toner carrying region is positioned below the bottom surface of another chamber arranged toward a side of the toner cartridge.

17. A developing apparatus according to claim 16, wherein the backflow prevention portion includes a barrier portion having a mesh member for preventing the toner from backflowing toward the toner cartridge.

18. A developing apparatus comprising:

an image carrier where an electrostatic latent image is formed;

a toner carrier for supplying toner to the electrostatic latent image formed on the image carrier; and a toner supply passage for supplying toner fed from a toner cartridge to a toner carrying region where the toner carrier is arranged, wherein the toner supply passage is provided with a backflow prevention portion for preventing the toner from backflowing toward the toner cartridge, the toner supply passage includes a first chamber connected to the toner cartridge at a first connectional portion and a second chamber connected to the first chamber at a second connectional portion formed in a lower side of the first chamber, the second chamber being connected to the toner carrying portion, and the backflow prevention portion includes barrier portions arranged on each of the first and the second connectional portions.

19. A developing apparatus according to claim 18, wherein the backflow prevention portion includes a barrier portion having a mesh member for preventing the toner from backflowing toward the toner cartridge.

* * * * *